US007281629B2

(12) United States Patent
Pavlansky et al.

(10) Patent No.: US 7,281,629 B2
(45) Date of Patent: Oct. 16, 2007

(54) END PIECE AND WIDE LINE RIBBON PACKAGE

(76) Inventors: Mark Pavlansky, 11831 Hwy. 268 E., Elkin, NC (US) 28621; Keith Pavlansky, 2508 Union Cross Rd., Yadkinville, NC (US) 27055

( * ) Notice: Subject to any disclaimer, the term of this patent is extended or adjusted under 35 U.S.C. 154(b) by 130 days.

(21) Appl. No.: 11/019,077

(22) Filed: Dec. 22, 2004

(65) Prior Publication Data

US 2006/0131195 A1 Jun. 22, 2006

(51) Int. Cl.
*B65D 85/00* (2006.01)
*B65D 71/10* (2006.01)

(52) U.S. Cl. ..... 206/410; 206/413; 206/497; 428/43

(58) Field of Classification Search ..... 209/389–416, 209/497; 428/43
See application file for complete search history.

(56) References Cited

U.S. PATENT DOCUMENTS 1,869,385 A * 8/1932 Maish ..... 428/43
3,660,958 A * 5/1972 Garrison ..... 206/410
3,669,255 A * 6/1972 Raymus ..... 206/397
3,731,792 A * 5/1973 Rolston ..... 206/410
3,837,480 A * 9/1974 Brunett ..... 206/497
3,856,141 A * 12/1974 Reed ..... 206/407
4,826,008 A * 5/1989 Cloosterman ..... 206/413
6,805,239 B2 * 10/2004 Smarr et al. ..... 206/416
6,805,240 B2 * 10/2004 Smarr et al. ..... 206/416
2005/0082192 A1 * 4/2005 Smarr et al. ..... 206/416

* cited by examiner

*Primary Examiner*—Bryon P. Gehman

(57) ABSTRACT

A package for a wide line, film ribbon which utilizes a pair of spaced-apart end pieces which engages a pair of spaced-apart end pieces engaging the end edges of the ribbon roll stored within the roll in multiple turns. A sheet of corrugated material is formed into a roll and inserted into the core opening of the film ribbon roll to stabilize the roll, and another sheet of corrugated material is wound about the outer surface of the roll to protect the surface and the roll itself from damage. A shrinkable overwrap encompasses the end pieces, the corrugated material, and the ribbon roll underneath to provide additional protection and maintain the components of the package and the film ribbon roll in a predetermined fixed relationship.

8 Claims, 1 Drawing Sheet

Figure 1
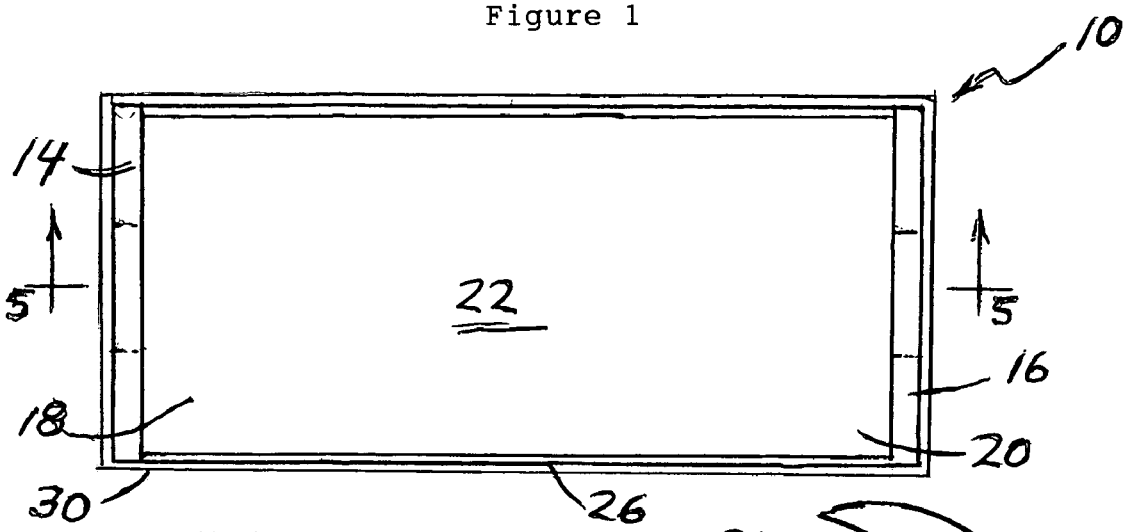
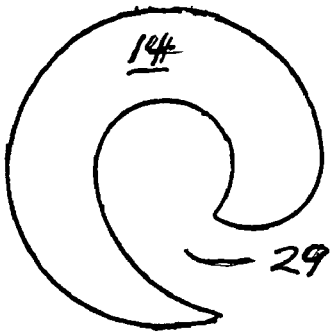
Figure 2
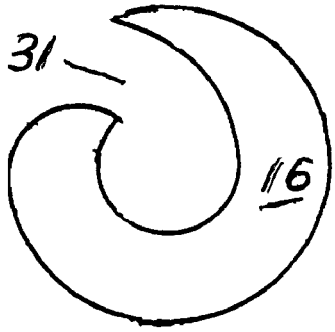
Figure 3
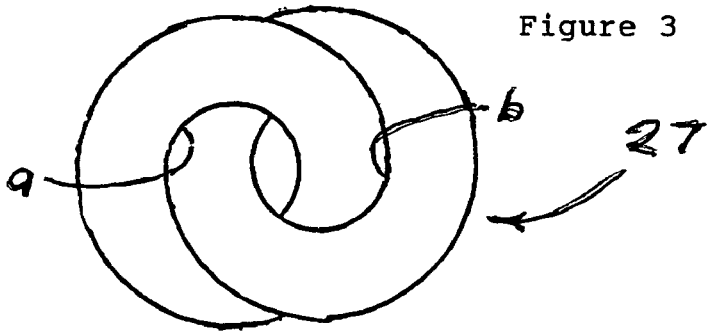
Figure 4
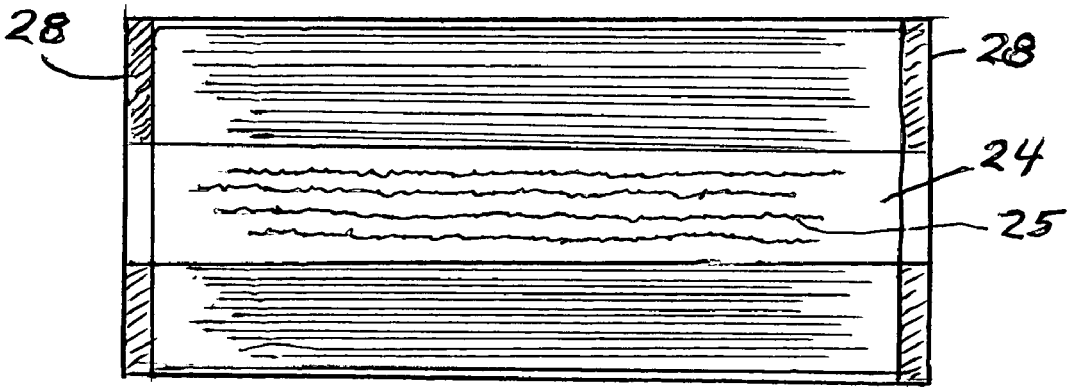
Figure 5

END PIECE AND WIDE LINE RIBBON PACKAGE

BACKGROUND OF THE INVENTION

1. Field of the Invention

The present invention relates generally to a wide line ribbon package and more specifically to a high strength unitary package including special end pieces for thin film ribbon protection while maintaining uniform ribbon edge alignment.

2. Description of Prior Art

It is well known in the art to employ molded container positioners in a package, however they have been usually associated with box and can packages and maintained adjacent the top and bottom in a parallel relationship. They may include depressions and recesses extending into the package.

However, packaging wide line ribbon stock, particularly when made up of thin film, presents problems that are not encountered in the can or box packaging art. Such material is typically 14 or more inches wide, twenty or more yards long and consist of a backing medium, an undercoating and one or more additional chemicals.

The ribbon, in this example, film, is centered upon and tightly wound about a supply core keeping the side edges in uniform alignment. The core is subsequently removed leaving an opening in the core or axis of the roll. It is important for the edges of a wide line film ribbon to be maintained uniformly aligned while being protected from knicking or tearing. Uniform alignment is essential for preventing ribbon jamming as it is fed through a high speed mechanism. The ribbon must, therefore, be constrained from telescoping while in the package.

Because of the combination of the high speed at which a wide line film ribbon typically move and the thinness of that ribbon, any knick or tear at the film ribbon edge usually leads to a tear across the entire width thereby necessitating costly replacement.

From the foregoing, it is obvious that constant improvements are needed to ensure secure and aligned movement of the film ribbon as it is being processed and packaged, and it is to that end that the present invention is directed.

OBJECTIVES AND SUMMARY OF THE INVENTION

A primary objective of the present invention is to improve the packaging of wide line film ribbon.

Another object of the invention is to develop an improved wide line film ribbon package that will prevent telescoping of the ribbon.

Yet another objective of the invention is to protect packaged film ribbon edges from knicks.

Still another objective of the present invention is to provide a new film ribbon package end piece that is relatively inexpensive, simple to install, and sufficiently protective of the film ribbon edges.

In achieving these objectives, the package for wide line, film ribbon of the invention utilizes a pair of spaced-apart end pieces engaging the end edges of the ribbon roll stored within the roll in multiple turns. A sheet of corrugated material is formed into a roll and inserted into the core opening of the film ribbon roll to stabilize the roll, and another sheet of corrugated material is wound about the outer surface of the roll to protect that surface and the roll itself from damage. A shrinkable overwrap encompasses the end pieces, the corrugated material, and the ribbon roll underneath to provide additional protection and maintain the components of the package and the film ribbon roll in a predetermined fixed relationship.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objectives of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

BRIEF DESCRIPTION OF THE DRAWINGS

FIG. 1 is a front elevational view of the wide line film ribbon package illustrating the orientation of the various components of the present invention;

FIG. 2 is a plan view of the first end piece used in the package shown in FIG. 1;

FIG. 3 is a plan view of the second end piece used in the package shown in FIG. 1;

FIG. 4 is a single foam cutout treated to yield the end pieces of FIGS. 2 and 3; and FIG. 5 is an elevational and sectional view of the package of FIG. 1 taken along the line 5-5 of FIG. 1.

DETAILED DESCRIPTION OF PREFERRED EMBODIMENT

A wide line film ribbon package is shown generally as 10 is provided with a pair of indentical end pieces 14, 16 each of which are positioned against the ends 18, 20 of film ribbon roll 22. Roll 22 has an opening or core 24 about the supporting axis when roll 22 was being formed, and this opening is filled with a sheet of corrugated material 25 which is rolled to a diameter size that substantially fills opening 24 thus providing a stabilizing element for roll 22.

Another sheet of corrugated material 26 is then wound about the periphery of roll 22 to give stability to and protection for the side edges 28 of the roll. The width of the encapsulating corrugated material 26 is substantially equal to the diameter of roll 22.

A shrinkable plastic material overwrap 30 encompasses end pieces 14, 16, film ribbon roll 22, the corrugated rolled material 25 in the roll core opening 24, and the encapsulating corrugated material 26 to provide protection for film ribbon roll 22 from atmospheric contamination and a single unitary package for safe handling.

End pieces 14, 16 are formed from a stamped foam cutout 27 shown in FIG. 4. The design of cutout 27 includes cut lines a and b so that end pieces 14, 16 are formed when cutout 27 is separated along lines a and b. Each end piece 14, 16 is less than a full circle of foam since the openings in the circular configuration of end pieces 14, 16 is missing a segment 29, 31.

In the preferred embodiment, end pieces 14, 16 may be manufactured according to known molding processes using materials such as foamed or unfoamed polystyrene or polyethylene, fibrous pulp, thermoplastic or thermosetting resins of either the foamed or unfoamed variety which for this application are formed in sheets. Cutout 27 is then stamped or die cut to the desired configuration. The configuration used in the preferred embodiment uses less material than the washer or full circle configuration that is commonly used where the outer diameter and shape of each end piece 14, 16 is essentially the same as the outer diameter of roll 22.

From the proceeding description, it can be seen that a film ribbon package and configured end pieces have been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

What is claimed is:

1. A package comprising: a pair of end pieces; at least one open-ended cylindrical roll disposed between the end pieces; a corrugated sheet encompassing the at least one open-ended roll; a shrinkable film overwrap encompassing the corrugated sheet and the at least one open-ended cylindrical roll, wherein the end pieces are formed from a sheet cutout member having interlocking circle configurations with an opening inside both circles that results in two end pieces when the sheet member is stretched and cut lines on the sheet cutout member separate.

2. The package as claimed in claim 1 wherein the end pieces are of foam material.

3. The package as claimed in claim 2 wherein the sheet cutout member comprises a stamped foam cutout including two curved cut lines, along which the foam member will be separated into two end pieces.

4. The package as claimed in claim 3 wherein each end piece is less than a full circle of foam.

5. The package as claimed in claim 3 wherein openings are formed between opposite ends of each end piece.

6. The package as claimed in claim 5 wherein the end pieces are formed from a material selected from the group comprising foamed polystyrene, foamed polyethylene, unfoamed polystyrene, unfoamued polyethylene, fibrous pulp, foamed thermoplastic resin, foamed thermosetting resin, unfoamed thermoplastic resin and unfoamed thermosetting resin.

7. The package as claimed in claim 1 wherein the end pieces comprise molded members.

8. The package as claimed in claim 1 wherein a sheet of corrugated material fills a core opening in the at least one open-ended cylindrical roll.

* * * * *